United States Patent [19]

Minter

[11] Patent Number: 4,571,899

[45] Date of Patent: Feb. 25, 1986

[54] ROOM ADDITION CONSTRUCTION

[75] Inventor: Mearl Minter, Oskaloosa, Iowa

[73] Assignee: Rolscreen Company, Pella, Iowa

[21] Appl. No.: 489,514

[22] Filed: Apr. 28, 1983

Related U.S. Application Data

[63] Continuation-in-part of Ser. No. 448,634, Dec. 10, 1982, and a continuation-in-part of Ser. No. 270,822, Jun. 5, 1981.

[51] Int. Cl.[4] ..... E04D 1/36

[52] U.S. Cl. ..... 52/60; 52/96; 52/460; 52/461; 52/573; 52/57; 52/467

[58] Field of Search ..... 52/459, 460, 461, 90, 52/95, 97, 282, 235, 94, 96, 573, 58, 57, 467, 466, 60, 62; 47/17

[56] References Cited

U.S. PATENT DOCUMENTS

| | | | |
|---|---|---|---|
| D. 245,996 | 10/1977 | Lukens . | |
| 980,433 | 1/1911 | Phillips . | |
| 1,454,079 | 5/1923 | Schalkenbach | 52/461 |
| 2,281,071 | 4/1942 | Knudsen . | |
| 2,501,418 | 3/1950 | Snowden, Jr. . | |
| 2,545,907 | 3/1951 | Watkins . | |
| 2,595,905 | 5/1952 | Telkes . | |
| 2,873,486 | 2/1959 | Hughes . | |
| 2,877,516 | 3/1959 | Bobel . | |
| 2,976,583 | 3/1961 | McCarthy . | |
| 3,008,196 | 11/1961 | Springer et al. . | |
| 3,022,549 | 2/1962 | Cummings . | |
| 3,028,938 | 4/1962 | Schorr | 52/459 |
| 3,129,471 | 4/1964 | Johnson et al. . | |
| 3,148,479 | 9/1964 | D'Amato . | |
| 3,324,620 | 6/1967 | Requena . | |
| 3,339,329 | 9/1967 | Berg | 52/461 |
| 3,562,972 | 2/1971 | D'Amato . | |
| 3,719,010 | 3/1973 | Hickman | 52/60 |
| 3,762,109 | 10/1973 | Cohen . | |
| 3,860,055 | 1/1975 | Wild . | |
| 3,987,597 | 10/1976 | Smrt . | |
| 4,018,213 | 4/1977 | Mann, Jr. . | |
| 4,027,437 | 6/1977 | Monsky . | |
| 4,057,841 | 11/1977 | Schwartz . | |
| 4,068,421 | 1/1978 | Marovich . | |
| 4,069,627 | 1/1978 | Pegg . | |
| 4,070,806 | 1/1978 | Hubbard | 52/95 |
| 4,076,013 | 2/1978 | Bette . | |
| 4,127,103 | 11/1978 | Klank et al. . | |
| 4,145,855 | 3/1979 | Sheldon . | |
| 4,154,028 | 5/1979 | Spaulding | 52/97 |
| 4,165,589 | 8/1979 | de Carteret | 52/62 |
| 4,173,855 | 11/1979 | Raptoplous . | |
| 4,201,019 | 5/1980 | Jones . | |
| 4,212,289 | 7/1980 | Hebert . | |
| 4,219,008 | 8/1980 | Schultz . | |
| 4,228,791 | 10/1980 | Hirai et al. | 52/460 |

FOREIGN PATENT DOCUMENTS

| | | | |
|---|---|---|---|
| 1529021 | 10/1978 | United Kingdom | 47/17 |

OTHER PUBLICATIONS

Sunlyt Home Greenhouse, Lord and Burhham, pp. 1–4.
Pella Sunroom, James A. Cassidy Co., Inc.
Ezpected Lean-to, p. 16, Texas Greenhouse Co., Inc.
Everlite Aluminum Greenhouses, Inc., pp. 1–9, Oct. 1975.
Janco Greenhouses, 1968, J. A. Nearing Co., Inc., pp. 12–13.

*Primary Examiner*—Donald G. Kelly
*Assistant Examiner*—Kathryn Ford
*Attorney, Agent, or Firm*—Zarley, McKee, Thomte, Voorhees & Sease

[57] ABSTRACT

A room addition type of construction for attachment to the outside wall of a building. The wall has an opening for access to the interior of the building. A foundation is provided adjacent the wall and an upright frame assembly is mounted on the foundation. The frame includes side wall frames, an outer wall frame, and a roof frame. A plurality of structurally independent panel members are securely mounted in each of the frame portions with a substantial portion of the panels comprising window units having glazing panels therein. The panel members cooperate with the frame assembly for providing load bearing support for the structure. The frame assembly is secured to the building and a weather seal is provided between the room structure assembly and the building. The panels are secured to each other and to the frame assembly and weather seals are provided between the panels and between the panels and the frame assembly.

19 Claims, 20 Drawing Figures

ROOM ADDITION CONSTRUCTION

This application is a continuation-in-part of U.S. Application Ser. No. 448,634 filed Dec. 10, 1982 and thereby of U.S. Application Ser. No. 270,822 filed June 5, 1981.

BACKGROUND OF THE INVENTION

Field of the Invention and Description of the Prior Art

This invention relates to a structural assembly that may be attached to the exterior wall of an existing or new building and it particularly relates to a room addition assembly, having a high proportion of windows, that may be attached to the wall of a building.

There is always a need for high-quality construction, including that for additions to existing buildings. In a similar way, there is always an existing need to have such high-quality construction be economical. This is particularly true during inflationary conditions, such as those that exist today. Because of the high cost of housing, many people are now choosing to add on to their present houses rather than seek out newer, larger homes. In essence, there is a particularly acute need for high-quality but economical construction, particularly for room additions and the like.

Another significant need that has arisen in the past several years is the need for energy efficient construction. One of the great relatively unused sources of energy useful for heat is solar heat. Particularly during the winter months, solar energy is considered to be highly useful for heating rooms, including room additions. This is generally accomplished by providing a large amount of window space in a room, including that of a room addition, in order to heat by passive solar energy. Where room additions are concerned, a further significant need is for weather tight construction, particularly along the joints of the room addition to the existing structure. If aluminum or aluminum clad panels are to be a part of a solar room addition, a still further significant need is for panel joints which accommodate panel expansion and contraction. Therefore, in summary, clearly, there is an acute existing need for high-quality, economical, energy efficient, weather tight, jointed construction, particularly construction that may be useful as a room addition for an existing building, including residences.

SUMMARY OF THE INVENTION

It is therefore an important object of the present invention to provide a unique room addition structural assembly which is characterized by its simplicity and economy of construction, its high-quality construction, its energy efficiency in design, its moisture tightness and its expandably jointed panels.

It is also an object of the present invention to provide a unique room addition structural assembly, wherein the assembly is substantially pre-constructed and designed to be attached to the exterior wall of an existing structure, such as a house, and wherein the exposed exterior walls and roof are comprised principally of window units with glazing panels therein.

It is another object of the present invention to provide a room structure assembly which is characterized by its uniqueness in construction by providing a plurality of window units with glazing panels, which are provided both on the side walls and on the roof, the window units acting as load bearing members to provide simplicity and economy of construction for the assembly.

It is still another object of the present invention to provide a room addition assembly which is constructed of a plurality of window units with glazing panels therein, which not only function as load bearing members, but which include unique members for weather tight, expandable securement of the panels to each other, to a surrounding frame structure and to an existing structure.

Further purposes and objects of the present invention will appear as the specification proceeds.

The foregoing objects are accomplished by providing a unique room addition type of assembly. The assembly may be attached to the exterior wall of an existing building, such as a residence. The wall has an opening therein for providing access between the interior of the building and the room structure. A foundation is positioned adjacent the wall, and an upright frame is mounted on the foundation.

The frame includes a pair of spaced side wall frame portions, an outer wall frame portion, and a roof frame portion. A plurality of structurally independent, pre-constructed panel members are securely mounted in each of the frame portions. A substantial proportion of the panels comprise window unit assemblies having glazing panels therein. The roof of the structure particularly includes a substantial portion of panel members with glazing panels therein. The panel members cooperate with the frame to provide load bearing support for the structure. The roof is gabled, and the point of the gable between the panels is capped.

Securing members including a unique flashing structure secure the frame assembly to the building. Weather seals are provided between the room structure assembly and the building. Securement members secure the panels to the frame assembly and to each other. Weather seals are defined between the panels and the frame assembly. A unique expansion joint between panels accommodates expansion and contraction of the panels.

The assembly thereby provides a sturdy, at least partially pre-constructed, economical, and thermally efficient room addition structure.

BRIEF DESCRIPTION OF THE DRAWINGS

Three particular embodiment of the present invention is illustrated in the accompanying drawings wherein.

DETAILED DESCRIPTION OF THE PREFERRED EMBODIMENTS

The preferred embodiments of FIGS. 1-16 of this application are the subject of U.S. patent application Ser. No. 448,634 of the invention filed Dec. 10, 1982. The disclosure of Ser. No. 448,634 is incorporated by repetition in this specification of portions of the disclosure of Ser. No. 448,634.

Figure 1:
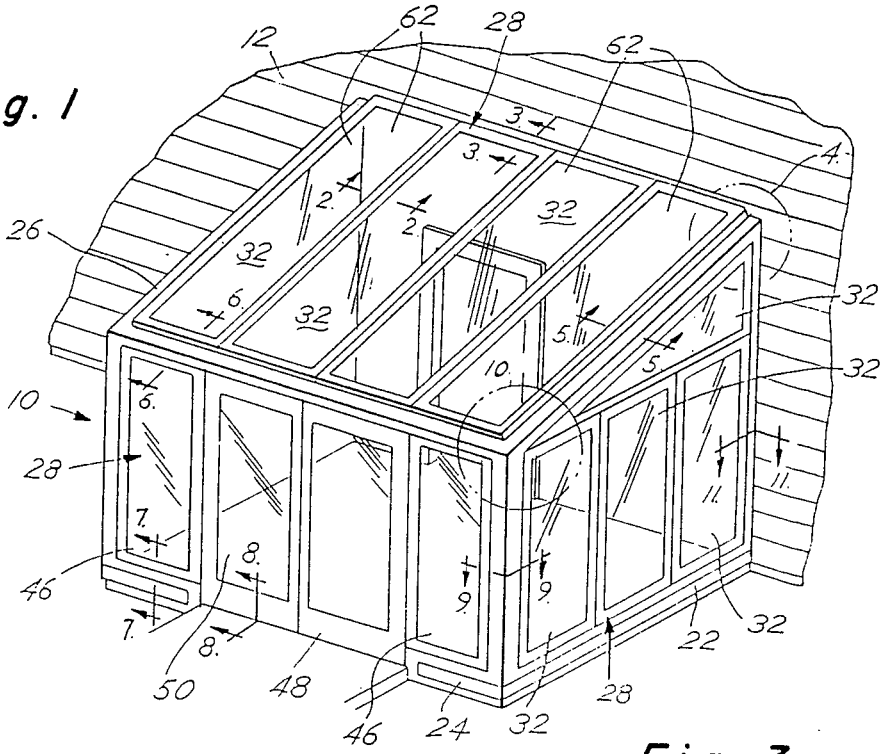
FIG. 1 is a perspective view of a preferred room addition assembly, which is attached to the exterior wall on an existing building, such as a residence.
Figure 12:
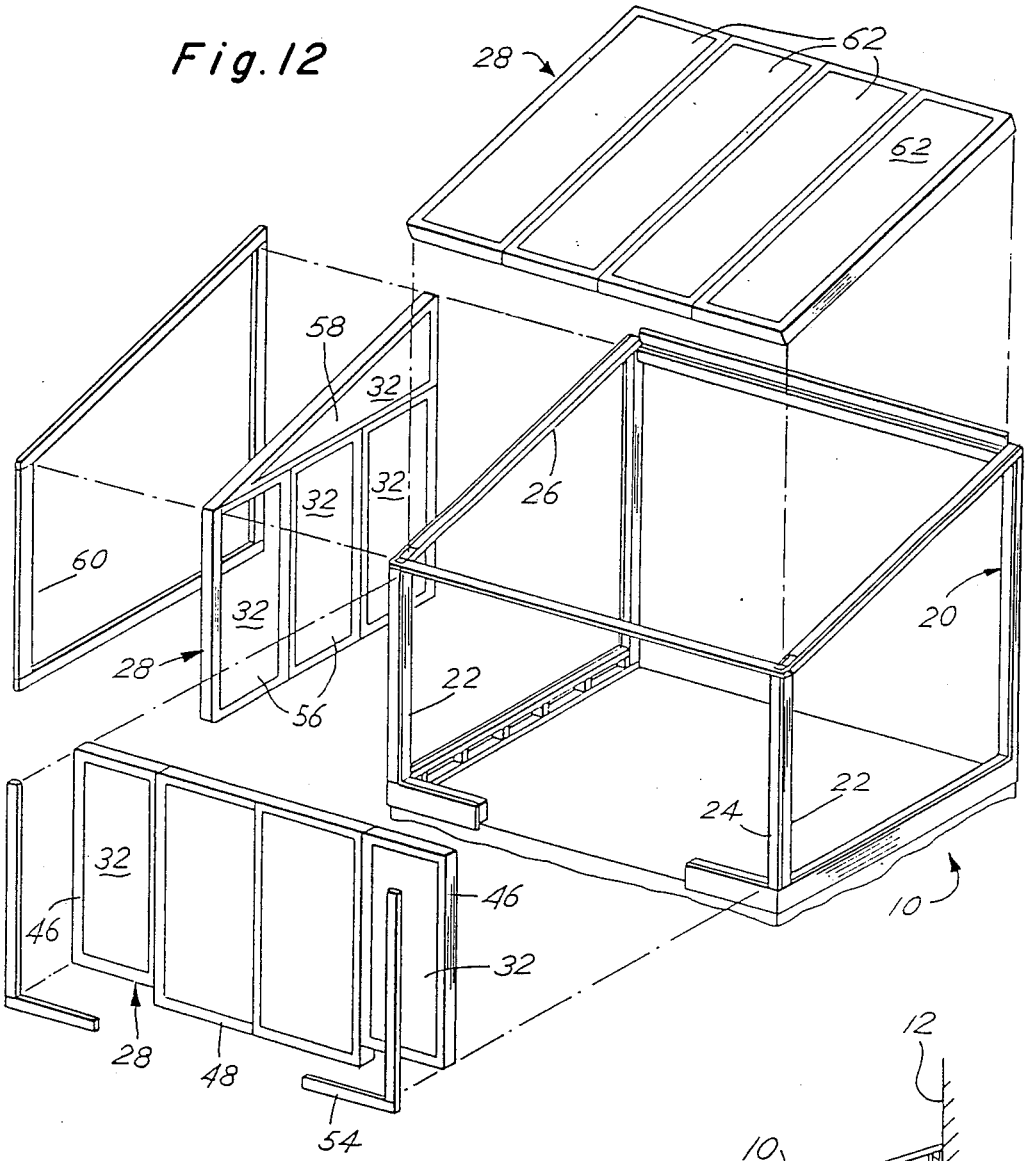
FIG. 12 is an exploded pictorial view of the embodiment of FIG. 1.
Figure 13:
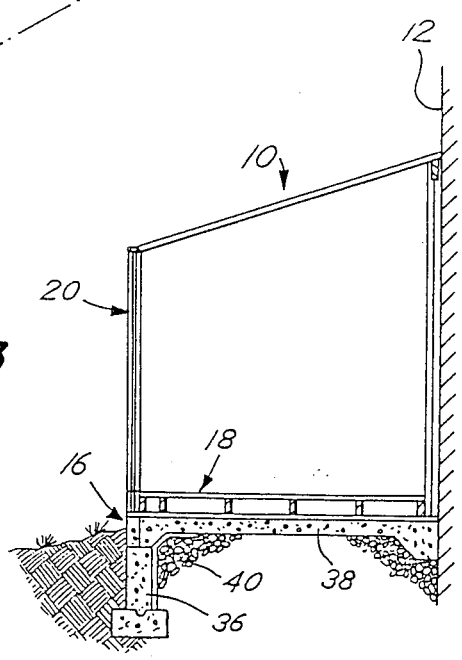
FIG. 13 is a transverse sectional view through the room structure assembly of FIG. 1.
Figure 14:
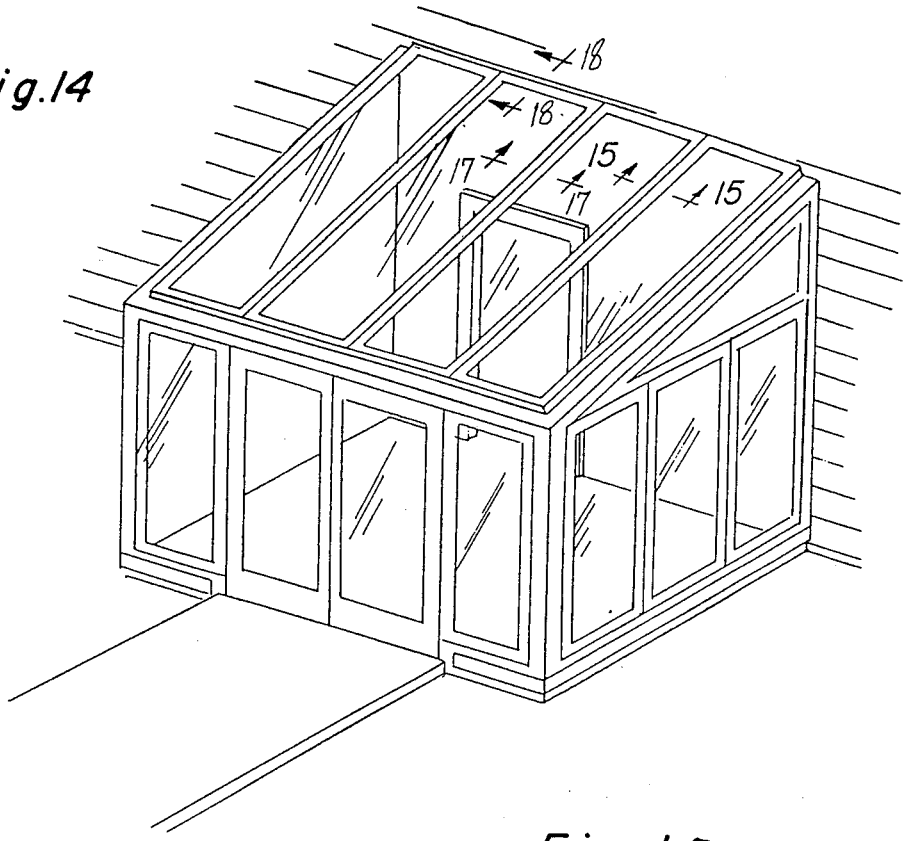
FIG. 14 is a view similar to FIG. 1 of a first alternative preferred room addition assembly.

With reference, in particular, to FIGS. 1, 12, and 13, a unique room addition structure, generally 10, is shown attached to and against the exterior wall 12 of an existing building. As seen best in FIG. 1, a doorway or opening is provided in the wall 12 in order to provide for access between the interior of the building and the interior of the room assembly 10.

The room structure assembly 10 includes, generally, a foundation, generally 16, a floor assembly, generally 18, an upright frame assembly, generally 20, which is mounted on the foundation 16 and floor assembly 18, the frame assembly 20 including a pair of spaced side wall frame portions 22, a front wall frame portion 24, and a roof frame portion generally 26; the assembly 10 further includes a plurality of structurally independent panel members, each of which is generally designated 28, it being understood that the panel members 28 may be of varying size and shape in the same assembly 10; a major proportion of the panel members 28 are comprised of window assemblies having glazing panels provided therein. The window units are generally of a casement type or of a double hung type, although, in the drawings, the window units in the outer walls are generally shown as casement units.

It is important that at least some window units are provided within the roof frame 26; the panel members 28 and the frame assembly 20 are cooperatively constructed and arranged to provide for load bearing support for the entire assembly 10. As generally shown in FIG. 1 and in greater detail in FIGS. 2-11, various securement members, generally designated 30, and suitable seals are provided for securing the panel members 28 to each other and to the frame assembly 20.

Because of difficulty in illustration, the securing members of the assembly of FIGS. 1-13, generally screws or nails, and the sealing elements of FIGS. 1-13, principally a sealing mastic, are not shown in FIGS. 1-13. The various elements that comprise weather seals, such as mullions or flashings, are, however, shown generally in FIGS. 1-13.

It is to be understood that the embodiment of the room assembly 10, as shown in the accompanying FIGS. 1-13 and to be hereinafter described in detail, is illustrative of one preferred embodiment of the invention. In particular, the structural details of the panel members 28 may vary over a wide range. The panel members shown in the accompanying drawings are shown as window units generally 32. However, it is to be understood that the panels 28 may be unglazed panels. It is important, however, that the structure 10 is to use a high proportion of glazed panels 32 and that at least some of the panels mounted in the roof frame 26 are to be of glazed window units 32. In essence, the more glazing that there is provided in the structure 10, the greater is the effect of solar energy for heating the room, that is, the greater the value of passive solar energy.

Although, in its simplest form, the room assembly 10 uses no heating source other than passive solar energy, it is to be understood that, for greater comfort, a heating system and/or air conditioning system may be used in connection with the assembly 10. The window units are also preferably double glazed. Similarly, and as schematically shown, for example, in FIG. 6, an adjustable slat shade assembly, generally 34, may be used in connection with the 32 in order to reduce the amount of solar energy which is passed into the interior of the room assembly 10.

In the room structure 10, it is one of the important features that the panel members 28 cooperate with the frame assembly 20 in order to provide for load bearing support for the entire assembly 10, both in the side walls and in the roof. In most known constructions, the window frame assemblies do not provide load bearing support for the building in which they are placed. This particular aspect of the assembly 10 provides for not only economical construction, but also greatly simplifies the construction while retaining high quality. Much of the structural detail of the assembly 10 of FIGS. 1-13 is conventional and well known to those skilled in the art. In essence, it is the overall combination of elements, as described, which provides the unique advantages of the embodiment of FIGS. 1-13.

Referring, in particular, to FIG. 13, the foundation 16 includes footings 36 which are placed below the frost line. A concrete subfloor 38 is poured in place adjacent the wall 12 of the building to which the assembly 10 is attached, with the footings 36 being located around the periphery of the floor 38. A rough floor is secured in a conventional manner to the cement floor 38 and is secured in place by conventional methods.

Insulating material 40, as needed, is placed in the space between the footings 36 and beneath the subfloor 38. A sheathing (not shown) is located on the exterior wall 12 of the building, to which the room assembly 10 is attachably secured. Although the size of the room assembly, that is, the length and width of the floor plan of the room may vary over a wide range, using conventional structural lumber, such as 2×4 framing members and when using conventional window units 32, whether of the casement type or of the double hung type, the room may vary in length between 11–19 feet and in width between 7–8 feet, with the width extending from the wall outwardly from the front frame 24. The slope of the roof may also vary although a conventional 4/12, 5/12 or 6/12 roof pitch is generally used.

Figure 3:
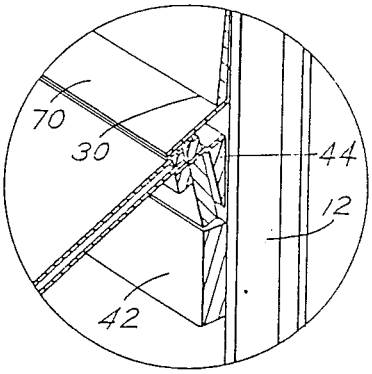
FIG. 3 is an enlarged, pictorial sectional view taken along the line 3—3 of FIG. 1 illustrating a seal-securing arrangement between the roof and the exterior wall of the building to which the room structure is attached.

Referring to FIG. 3, a bearing plate 42 and nailing wedge 44 are secured to the wall 12 by nails or screws and act to support the rear upper edge of the roof frame 26 with the panel members 28 which define the roof assembly. As seen, the nailing wedge 44 is secured in place immediately above the transversely, and horizontally mounted bearing plate 42.

Figure 8:
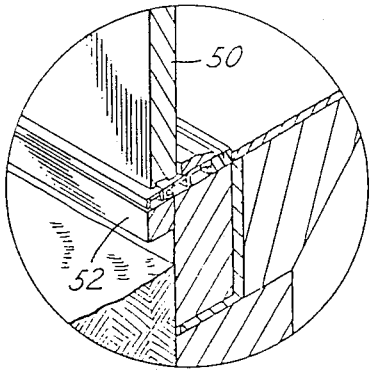
FIG. 8 is an enlarged, pictorial sectional view taken along the line 8—8 of FIG. 1; illustrating the bottom of a sliding door assembly.

Preferably, the panel members 28 in the front frame 24 include a pair of oppositely spaced fixed window units 46 and a sliding door unit 48. The sliding door unit 48 includes a sliding door portion 50 in which the upper side, and lower side, as seen in FIG. 8, are guided in a lower guide track 52. As seen in FIG. 12, an outer blocking frame 54 secures the window units 46 and sliding door units 48 rigidly in place to the front wall frame portion 24.

As with the window units 46 and sliding door unit 48, a pair of window units, including a plurality of generally upright window units 56 and an upper wedge shaped glazing unit 58, are rigidly secured to the opposite side frames 22 and are secured in place therein by side wall blocking frames 60, as best seen in FIG. 12. Although the window units 56 may be either casement or double hung type of units, the wedge shaped unit 58 is fixed.

Figure 2:
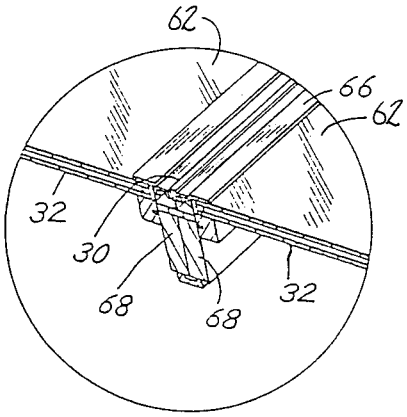
FIG. 2 is an enlarged, pictorial sectional view taken along the line 2—2 of FIG. 1, illustrating a typical sealing and securing arrangement between adjacent window frames.

A plurality of sun roof units 62 extend transversely outwardly and downwardly from the wall 12 to the intersection of the roof frame 26 with the front frame 24. A mastic type caulking material (not shown) is placed between abutting edges of the frames of the roof units 62, as best seen in FIG. 2, as well as between the window frames and the roof frame. The roof units 62 are of unitary construction and are in abutting relationship. Desirably, the roof units in particular have slat shades mounted therein, either between a pair of spaced glazing panels (manufactured under the trademark SLIMSHADE) or alternatively, adjacent the underside of one of the glazing panels of the sunroof window unit 62.

A mullion cover 66 as best seen in FIG. 2, preferably of an extruded metal material, is secured in place over the joint between the abutting units 62. The mullion cover 66 also acts to protect the mastic sealing material which is sealably compressed between the lateral edges 68 of the window units 62. This arrangement protects the sealing material from the sun to thereby extend the life of the mastic.

Figure 15:
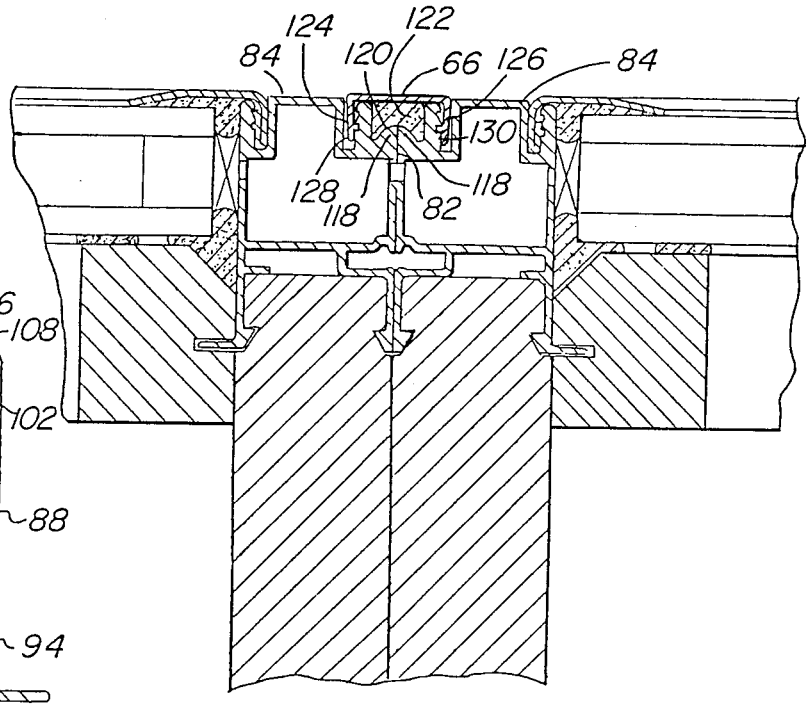
FIG. 15 is an enlarged, sectional view taken along the line 15—15 of FIG. 14, illustrating a preferred sealing and securing arrangement between adjacent window frames.
Figure 16:
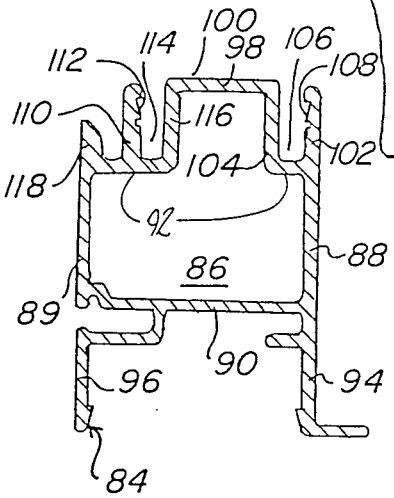
FIG. 16 is a sectional view of an isolated one of the glazing flanges of the arrangement of FIG. 15.

As most preferred, the mullion cover 66 is secured in place over a joint 82 between two glazing flanges 84 of the abutting units 62, as shown in FIG. 15. The flanges 84 are mirror images of each other, and as best seen in FIG. 16, each includes a central, box-like portion 86. Two thin, upright, parallel wall sections 88, 89 form the sides of the central portion 86, and are joined by a perpendicular, lower wall section 90, and a thin, shaped, upper wall section 92. Two legs 94, 96 extend below the lower wall section 90. The leg 94 is attached at the juncture of the wall sections 88, 90, while the leg 96 is attached to the lower wall section 90 between the wall sections 88, 89.

The upper wall section 92 includes an upwardly thrust U-shaped portion 98 with an exposed surface 100. A first serrated arm 102 projects upward from the juncture of the wall sections 88, 92 to a height just less than the surface 100. The arm 102 and side 104 of the U portion 98 form a first recess 106, which the serrations 108 of the arm 102 face. A second serrated arm 110 with serrations 112 forms a second recess 114 with the opposite side 116 of the U portion 98. The arm 110 is spaced from the juncture of the wall sections 89, 92.

A quarter-round nib 118 projects upward from the juncture of the wall sections 89, 92 to a height reduced from that of the arms 102, 110 and U portion 98.

As in FIG. 15, flanges 84 are abutted with nibs 118 touching, thereby forming a mastic channel 120 above the nibs 118 between the arms 110. Mastic 122 is placed in the mastic channel 120. The mastic filled channel 120 is then covered by the mullion cover 66, which has downwardly extending legs 124, 126 with barbs 128, 130 fitted, respectively, in the recesses 114 and held in tension by the serrations 112.

Figure 17:
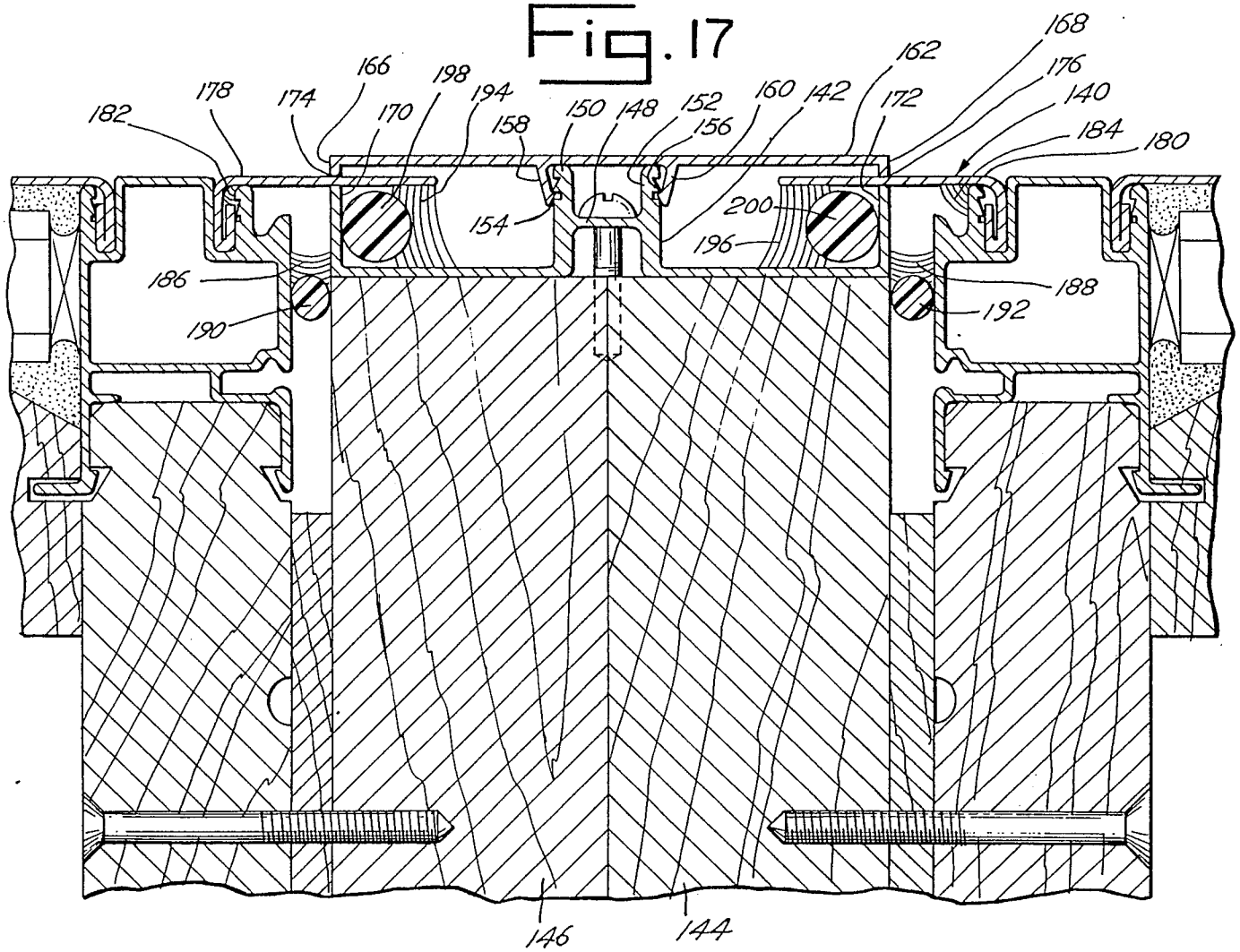
FIG. 17 is an enlarged, sectional view taken along line 17—17 of FIG. 14.

The channel 120 has a bottom surface formed by the nibs 118 which has an inverted U shape. Thus, the mastic 122 in the channel 120 has a central, shallow neck and deeper, non-central, downwardly directed ridges. The ridges anchor the mastic 122 to the flanges 84, in the event of tension tending to separate the flanges 84. This anchoring action results in tension stretching the neck, rather than breaking the mastic free of the flanges 84. To prevent the tension of the mullion cover 66 from causing rotation of the flanges 84 upward about the mullion cover 66, the bottom of the channel 120 below the mastic ridges is raised above the bottoms of the recesses 114.

Where the room structure assembly is elongated, at least one mid-roof joint between abutting units 62 is secured by a controlled expansion joint assembly 140, as in FIG. 17. In such an assembly 140, a control joint cap support 142 surmounts two parallel frame members 144, 146. A central fastener portion 148 of the support 142 is fastened to the frame members 144, 146, between two upright, serrated arm portions 150, 152. Barbs 154, 156 on two legs 158, 160, respectively, of a control joint cap 162 hook the arm portions 150, 152, respectively, to hold the cap 162 to the support 142.

The support 142 and cap 162 extend to the outer edges of the frame members 144, 146. Downwardly turned flanges 166, 168 on the cap 162 and upwardly turned flanges 170, 172 on the support 142 form slots 174, 176. Control joint flashing members 178, 180 slidably fit the slots 174, 176 and are hooked on the adjacent glazing flanges 84. Mastic beads 182, 184 fill between the flashing members 178, 180 and the arms 110 of the flanges 84. Further mastic beads 186, 188 over mastic necking rods 190, 192 fill between the frame members 144, 146 and the flanges 84. Still further beads 194, 196 along rods 198, 200 fill between the control joint flashing members 178, 180 and the cap support 142, adjacent the flanges 170, 172.

The rods 190, 192, 198, 200 aid in keeping their respective mastic beads flexible. Thus, expansion and contraction across the roof units 62 is accommodated by sliding movement of the joint flashing members 178, 180 in the slots 174, 176. Water intrusion is prevented by the structure of the assembly 140 and the mastic beads thereof.

Figure 4:
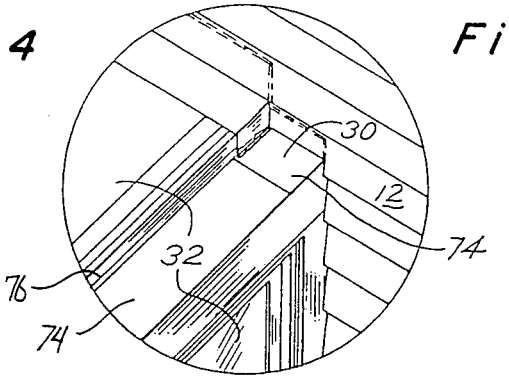
FIG. 4 is an enlarged, pictorial view, of view 4 of FIG. 1, illustrating an upper, inner corner of the room structure of FIG. 1.

As seen in FIG. 3, a top flashing 170 is secured in place at the junction between the rear edge of the roof on the wall 12 in order to provide for the sealing relationship therebetween. Flashing 74, as best seen in FIG. 4, is located at the intersection of the side wall, the roof, and the wall 12.

Figure 18:
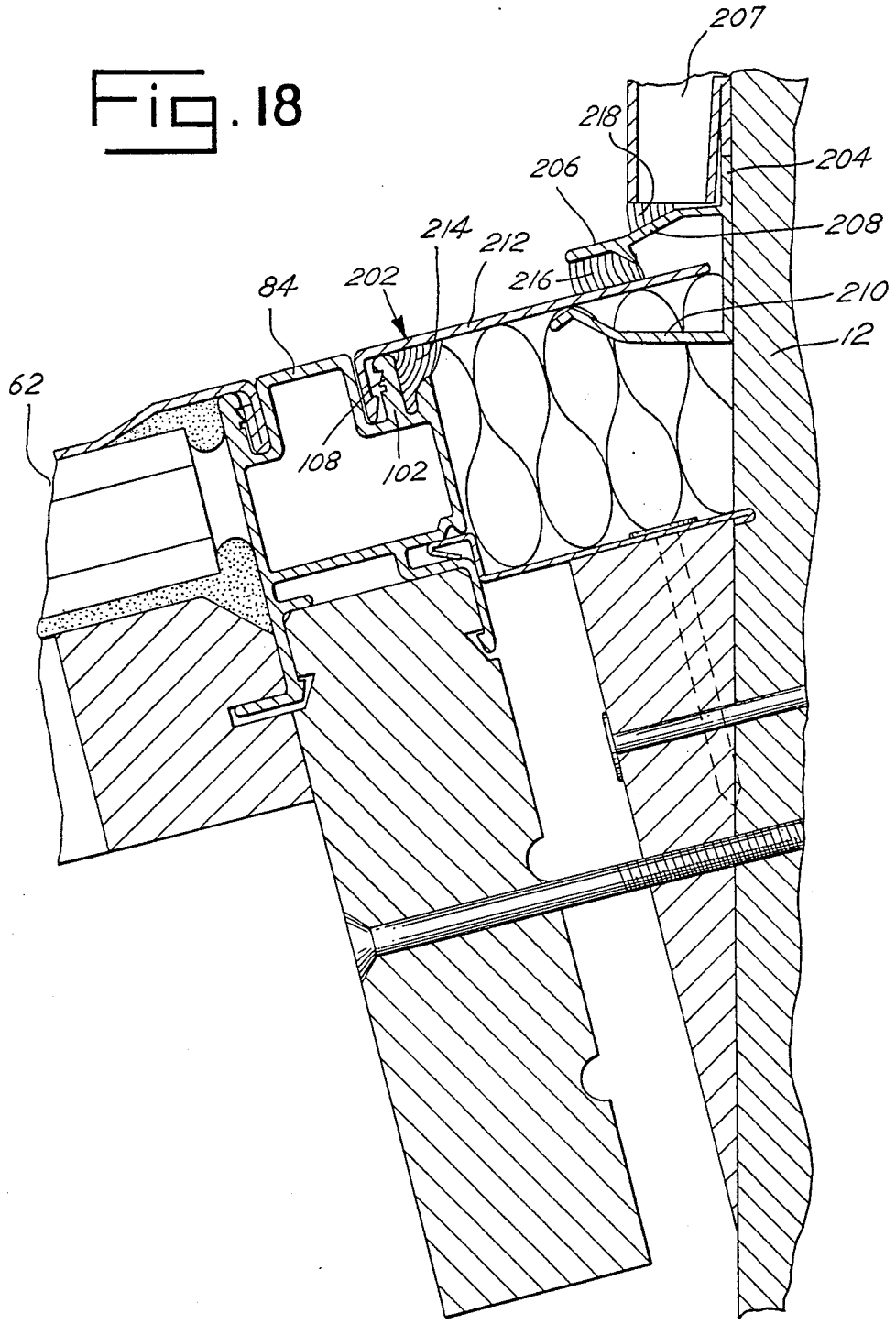
FIG. 18 is an enlarged, sectional view taken along the line 18—18 of FIG. 14, illustrating a unique flashing arrangement between the roof and the exterior wall of the building, preferred over the seal-securing arrangement of FIG. 3.

As most preferred, especially over flashing 70, the junction between the roof of the room assembly and the wall 12 is completed by a top flashing assembly 202, as in FIG. 18. An upwardly extending fastener portion 204 of a top flashing receptor 206 is fitted and fastened under sliding 207 on the wall 12. Two spaced, receptor jaws 208, 210 extend outward of the wall and portion 204 to receive a top flashing member 212. The member 212 extends to the glazing flange 84 of room roof units 62, and is hooked to serrations 108 of the flange arm 102. Mastic 214 fills between the arm 102 and member 212. Mastic 216 fills between the member 212 and the upper receptor jaw 208, while mastic 218 fills above the jaw 208. The flashing member 212 and receptor 206 accommodate variations in the joint between the room assembly and wall 12 during construction. They also provide a sure, weather tight joint which is flexible to expansion, settling and the like.

Figure 5:
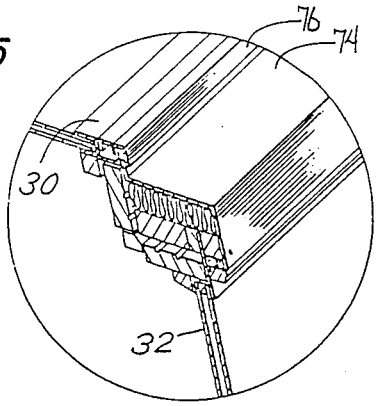
FIG. 5 is an enlarged, pictorial sectional view taken along the line 5—5 of FIG. 1, illustrating an outer edge of the roof of the room assembly.

In FIG. 5, it is seen that a sunroof side flashing 74 and a counter flashing 76 are secured in place over the lateral edges of the roof of the assembly 10.

Figure 6:
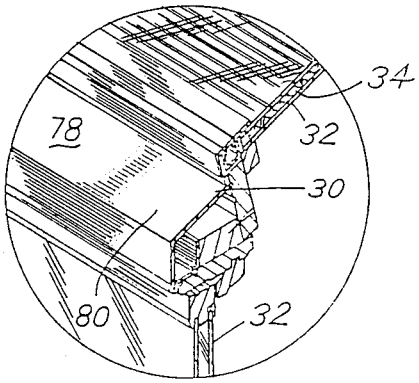
FIG. 6 is an enlarged, pictorial sectional view taken along the line 6—6 of FIG. 1, illustrating the outer lower corner of the roof of the structure of FIG. 1.
Figure 7:
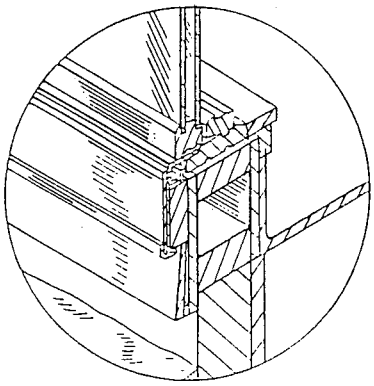
FIG. 7 is an enlarged, pictorial sectional view taken along the line 7—7 of FIG. 1; illustrating a typical bottom of a wall portion along the foundation.
Figure 9:
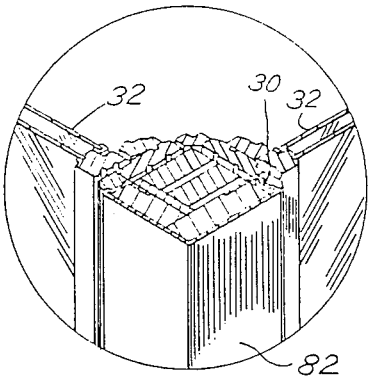
FIG. 9 is an enlarged, pictorial sectional view taken along the line 9—9 of FIG. 1, illustrating the front upright corner of the room assembly.
Figure 10:
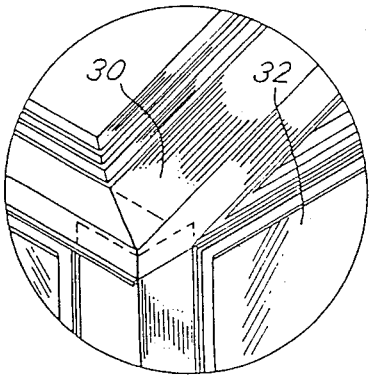
FIG. 10 is an enlarged, pictorial view of view 10 of FIG. 1, illustrating an outer corner of the roof assembly.
Figure 11:
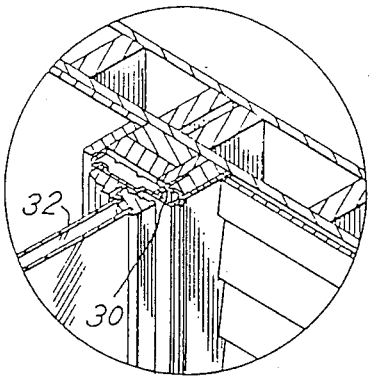
FIG. 11 is an enlarged pictorial setional view taken along the line 11—11 of FIG. 1 illustrating the rear upright corner of the assembly where it attaches to the building.

Referring to FIG. 6, a counter flashing 78 is secured in place along the outer lower edge of the roof assembly. A bottom flashing 80 is similarly secured in place below the flashing 78. A pair of upright mullion covers 82 cover the outer upright exterior corners of the frame assembly 20, as best seen in FIG. 9.

In installing the various flashings and mullions, caulking is applied in order to provide for a weather-tight seal between the various flashings or mullion covers and the frame itself.

Figure 19:
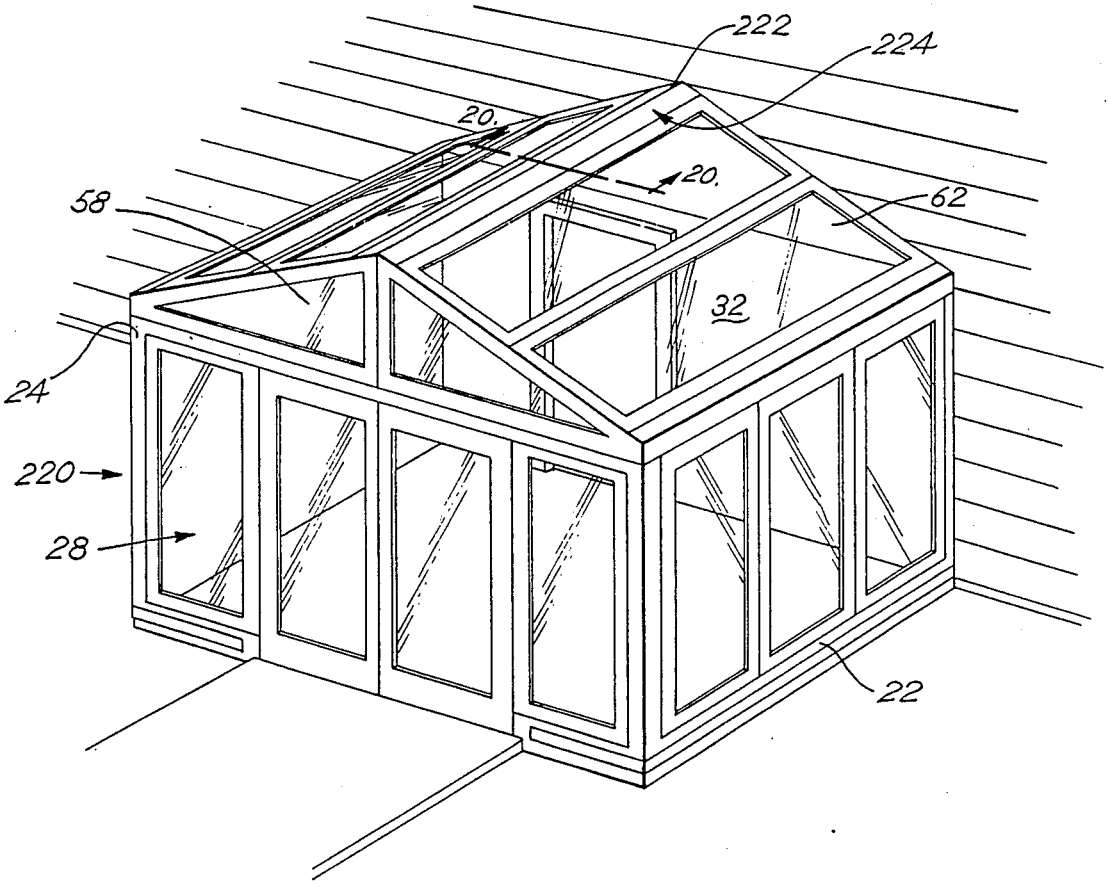
FIG. 19 is a view similar to FIGS. 1 and 14 of a second alternative, gabled room addition assembly.
Figure 20:
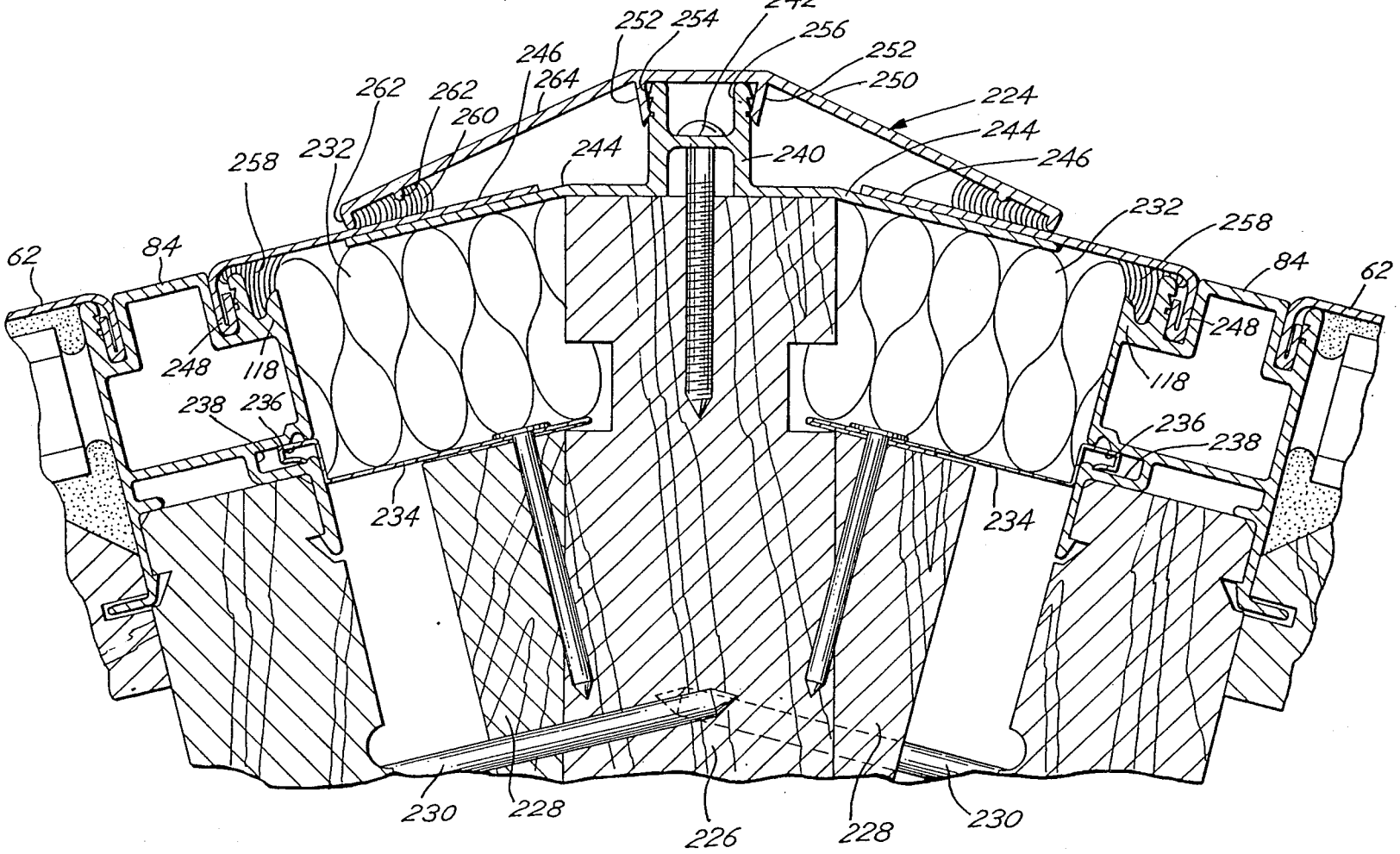
FIG. 20 is an enlarged, sectional view taken along line 20—20 of FIG. 19, of a preferred, gable cap assembly.

Turning to FIGS. 19–20, a gabled room structure assembly 220 includes glazed window units 32 as panel members 28 and sun roof units 62, and other elements of the room assembly 10. Upper wedge shaped glazing units 58 are rigidly secured to the front wall frame portion 24, not the opposite side frames 22.

The sun roof units 62 slope toward a central, gable peak 222 atop the wedge shaped units 58. In addition, a gable cap assembly 224 protects the peak 222. As in FIG. 20, a gable peak framing member 226 extends along the peak 222. Wedge shaped framing cap support members 228 are fastened along the sides of the peak framing member 226. The two sun roof units 62 forming the peak 222 are fastened to the members 228, at 230. Insulating material 232 fills the space between each adjacent sun roof unit 62 and the peak framing member 226, atop a peak insulation support 234. Each support 234 is fastened to a framing cap support member 228, with a retaining flange 236 inserted in a recess 238 in the adjacent glazing flange 84.

A frame cap support 240 is fastened atop the peak framing member 226, through a central, fastener receiving portion 242. A pair of cap support wings 244 extend from the portion 242, at least partially across the gap between the peak frame member 226 and the adjacent glazing flanges 84. Cap flashing members 246 overlie the wings 244, and extend to portions 248, engaged in the flange 84. A frame cap 250 snaps over the cap support 240, with two downwardly extending legs 252 hooking serrations 254 in two upright arms 256 of the cap support 240. Mastic 122 fills mastic channels 258 between the nibs 118 of the flanges 84 and the cap flashing members 246. Mastic 122 also fills the mastic channels 260 formed between the ribs 262 of cap wings 264 and the underlying cap flashing members 246.

While in the foregoing there has been provided a detailed description of particular embodiments of the present invention, it is to be understood that all equivalents obvious to those having skill in the art are to be included within the scope of the invention as claimed.

What I claim and desire to secure by Letters Patent is:

1. An expansion joint assembly for weatherproofing a joint between a pair of panel units positioned on each side of a frame member, comprising:

a cap support attached to said frame member and having opposite upstanding outer arms each terminating in an upper edge;

a joint cap secured to said cap support, and having opposite downwardly extending outer legs each terminating in a lower edge;

said lower edges of said outer legs of said joint cap being closely spaced above said upper edges of said outer arms of said cap support so as to define a slot therebetween; and a pair of joint flashings each having a first end attached to one of said panel units and an opposite second free end laterally movably extending into one of said slots between said cap support and said joint cap so as to permit expansion and contraction of said panel units and said upper and lower edges being in substantially linear engagement with said flashing whereby said flashing is pivotally received within said slot so as to permit movement of said panel units.

2. The assembly of claim 1 wherein said cap support includes opposite upwardly extending inner serrated arms interconnected by a central portion, said central portion being adapted to receive a fastener means for attaching said cap support to said frame member.

3. The assembly of claim 2 wherein said joint cap includes opposite downwardly extending inner barbed legs for lockingly engaging said serrated arms of said cap support thereby securing said joint cap to said cap support.

4. The assembly of claim 1 wherein said second end of said joint flashing is substantially planar so as to slidably fit within said slot.

5. The assembly of claim 2 wherein said central portion of said cap support includes a web interconnecting said upright inner arms, said fastener means extending through said web to attach said cap support to said frame member.

6. A flashing assembly for weatherproofing a junction between a roof and a wall extending upwardly beyond said roof, said roof including a panel unit adjacent said wall, said flashing assembly comprising:

a flashing receptor having a fastener portion secured to said wall and upper and lower spaced apart jaw members extending outwardly from said fastener portion so as to define an enlarged mouth area, a flashing member having an under surface and a first end secured to said panel unit and a second free end laterally movably extending into said mouth area between said upper and lower jaws and the under surface being slidably supported and engaged by said lower jaw to permit expansion and contraction of said panel units.

7. The assembly of claim 6 wherein said lower jaw member includes a first end integrally formed with said fastener portion and a second end having a downwardly angled lip for guiding said second end of said flashing member into said mouth area.

8. The assembly of claim 7 wherein said upper jaw member includes a first end integrally formed with said fastener portion, a second end, and a projection intermediate said first and second ends extending toward said lower jaw member to maintain a space between said second end of said flashing member and said second end of said upper jaw member.

9. The assembly of claim 8 wherein said projection is angled toward said fastener portion of said flashing receptor so as to further guide said flashing member into said mouth area.

10. The assembly of claim 7 wherein said lower jaw member includes a middle portion intermediate said first and second ends thereof, said middle portion angling upwardly from said first end and terminating in said downwardly angled lip to permit pivotability of said flashing member within said mouth area.

11. The assembly of claim 8 wherein said second end of said upper jaw member is angled downwardly.

12. A flashing assembly for weatherproofing a junction between a roof and a wall extending upwardly beyond said roof, said roof including a panel unit adjacent said wall, said flashing assembly comprising:

a flashing receptor having a fastener portion secured to said wall and upper and lower spaced apart jaw members extending outwardly from said fastener portion so as to define an enlarged mouth area, a flashing member having a first end secured to said panel unit and a second free end laterally movably extending into said mouth area between said upper and lower jaws to permit expansion and contraction of said panel units;

said upper jaw member including a first end integrally formed with said fastener portion, a second end, and a projection intermediate said first and second ends extending toward said lower jaw member to maintain a space between said second end of said flashing member and said second end of said upper jaw member.

13. A flashing assembly for weatherproofing a junction between a roof and a wall extending upwardly beyond said roof, said roof including a panel unit adjacent said wall, said flashing assembly comprising:

a flashing receptor having a fastener portion secured to said wall and upper and lower spaced apart jaw members extending outwardly from said fastener portion so as to define an enlarged mouth area;

a flashing member having a first end secured to said panel unit and a second free end laterally movably extending into said mouth area between said upper and lower jaws to permit expansion and contraction of said panel units;

said lower jaw member including a first end integrally formed with said fastener portion and a second end having a downwardly angled lip for guiding said second end of said flashing member into said mouth area.

14. The assembly of claim 1 wherein said cap support includes a base portion from which said outer arms extend, said second end of said joint flashing cooperating with said base portion and said outer arm of said cap support to form a mastic channel for receiving flexible mastic material, said mastic material extending between and adhering at least to said second end of said outer arm and said base portion of said cap support.

15. The assembly of claim 14 wherein said mastic material has opposite side sections adjacent said second end of said joint flashing and said base portion of said cap support, respectively, and a midsection between said opposite sides, said midsection having a reduced thickness with respect to the thickness of said side sections such that said mastic material stretches in response to movement of said joint flashing relative to said cap support without shearing the adhesion between said mastic channel and said joint flashing and cap support.

16. The assembly of claim 15 further comprising convex means engaging said mastic material for forming and maintaining the reduced thickness midsection of said mastic material.

17. The assembly of claim 16 wherein said convex means does not adhere to said mastic material.

18. The assembly of claim 17 wherein said second end of said gable flashing is substantially planar so as to slidably fit within said narrow slot.

19. The assembly of claim 18 wherein said cap wings each have a downwardly extending leg at the outer edge thereof, each of said legs having a lower edge being closely spaced above said opposite support wings of said cap support so as to define said slot therebetween for receiving said gable flashing.

* * * * *